US007963003B1

(12) United States Patent
Keene

(10) Patent No.: US 7,963,003 B1
(45) Date of Patent: Jun. 21, 2011

(54) DECORATIVE APPLIANCE CONTROL KNOB

(76) Inventor: Melanie J. Keene, Clermont, FL (US)

( * ) Notice: Subject to any disclaimer, the term of this patent is extended or adjusted under 35 U.S.C. 154(b) by 276 days.

(21) Appl. No.: 12/422,576

(22) Filed: Apr. 13, 2009

(51) Int. Cl.
*G05G 1/06* (2006.01)

(52) U.S. Cl. ..... 16/441; 16/DIG. 30; 40/331

(58) Field of Classification Search ..... 16/441, 16/114, 417, 431, 110.1, 111.1, DIG. 30; 74/553; 292/347, 349; 40/331
See application file for complete search history.

(56) References Cited

U.S. PATENT DOCUMENTS

| | | | | |
|---|---|---|---|---|
| 2,171,361 | A | 8/1939 | Gits et al. | |
| 2,283,905 | A | 5/1942 | Beal | |
| 2,888,282 | A | 5/1959 | Naimer | |
| D185,604 | S | 6/1959 | Johnson | |
| D185,814 | S | 8/1959 | Johnson | |
| 3,313,057 | A * | 4/1967 | Leddy | 40/331 |
| 3,410,247 | A * | 11/1968 | Dronberger | 116/311 |
| 3,543,329 | A | 12/1970 | Gulette et al. | |
| 3,679,252 | A | 7/1972 | Howie, Jr. | |
| 3,965,529 | A | 6/1976 | Hadzimahalis | |
| 4,353,139 | A | 10/1982 | Wainwright | |
| 4,510,666 | A | 4/1985 | Howie, Jr. | |
| 4,608,882 | A | 9/1986 | Howie, Jr. | |
| 4,796,329 | A * | 1/1989 | Bory | 16/441 |
| D340,637 | S | 10/1993 | Campbell et al. | |
| D355,834 | S | 2/1995 | Chieda | |
| 5,509,174 | A * | 4/1996 | Worrell | 16/441 |
| 5,931,150 | A | 8/1999 | Bowen | |
| 6,242,064 | B1 * | 6/2001 | Howie, Jr. | 428/35.7 |
| 6,463,630 | B1 * | 10/2002 | Howie, Jr. | 16/441 |
| D493,090 | S | 7/2004 | Chen | |
| 6,842,946 | B2 | 1/2005 | Hayden | |
| 7,036,188 | B1 * | 5/2006 | Howie, Jr. | 16/441 |
| 7,111,365 | B1 * | 9/2006 | Howie, Jr. | 16/441 |
| D539,087 | S | 3/2007 | McKenzie | |
| 2002/0096169 | A1 | 7/2002 | Gabelmann | |
| 2007/0069090 | A1 | 3/2007 | Driscoll | |

* cited by examiner

*Primary Examiner* — William L. Miller
(74) *Attorney, Agent, or Firm* — Andrew D. Mead

(57) ABSTRACT

A user-configurable replacement control knob for use on a household appliance, such as a stove. The control knob can be used to replace originally-supplied control knobs and allows individuals to tailor the aesthetics of the appliance to suit their preferences. The knob is user-configurable for control rotational direction by installing one of a plurality of uniquely configured indicator inserts into a receptacle on the forward side of the knob. The knob may also be adapted to interface with differing appliance control shaft configurations by inserting one of a plurality of torque inserts into a receptacle on the rearward side of the knob. Decorative faces on the knobs are visually fashioned in various color schemes and tactilely shaped to resemble various decorative forms that may be used to enhance or accent an overall kitchen décor. The replacement control knob provides the same function as a standard appliance control knob and allows appliance control knobs to be used as room decorating accessories.

20 Claims, 4 Drawing Sheets

DECORATIVE APPLIANCE CONTROL KNOB

BACKGROUND OF THE INVENTION

This invention relates generally to decorative items and specifically to decorative knobs used to replace standard oven, stove and other appliance control knobs to alter the appearance of the appliance for aesthetic purposes.

The household kitchen provides countless possibilities for individuals to customize aesthetics to suit their own personal preferences. Wall paint and coverings, window treatments, table cloths and place mats, table centerpieces, and kitchen utensils may all be selected to coordinate and create a pleasing overall appearance in the kitchen. Kitchen appliances, especially large appliances such as stoves, ranges, and refrigerators, are typically available in limited colors often requiring individuals to compromise their decorative plans. Moreover, the appearance of control knobs typically supplied with large appliances is optimized for control function with little regard for coordination with the surrounding decor. U.S. Design Pat. 493,090 discloses a typical rotary control knob for an appliance.

Knobs having decorative features are well known in the art. U.S. Pat. No. 3,543,329 by Gulette discloses a transparent plastic knob enclosing changeable metallic caps that give the appearance of a metal knob. Changing the color or material of the metal cap allows the appearance of the knob to be altered to suit a specific decor need while using a common knob structure. The shape of the knob is not altered by the different metallic caps. U.S. Pat. No. 4,608,882 by Howie discloses a control knob having an improved decorative end cap that may be changed to alter the appearance the control knob. Howie also teaches use of different metallic end caps to provide a richer appearance than that of a pure plastic control knob. In practical use, a single design is typically used in multiple locations on a single appliance, such as a kitchen range. So while the appearance of the knobs may be altered during production, a matched set is generally used on a single appliance.

Decorative knobs are also well-known in other uses, such as door and furniture knobs. Higher emphasis is placed on integrating these knobs with their surrounding decor. Ornate designs are commonly employed on furniture as drawer and door pulls. U.S. Design Pat. 355,834 by Chieda discloses a drawer pull knob designed to resemble a basket fruit and vegetables and is illustrative of the art. Door knobs are another application in which greater design variety exists. U.S. Design Pat. 340,637 by Campbell discloses a decorative door or cabinet knob in the shape of a pig's head. However, none of these designs are envisioned for use as appliance controls.

It would be desirable to provide a cost-effective method to enable individuals to exercise greater flexibility in coordinating design elements in their household kitchens to suit a wider variety of aesthetics.

SUMMARY OF THE INVENTION

Accordingly, it is an object of the present invention to provide a control knob for household appliances that provides the user alternative control knobs having distinctive visual and tactile appearance and which are user configurable for specific appliances.

It is a further object of the present invention to provide a replacement control knob for a household appliance having control indicia that is user-configurable for clockwise or counterclockwise control operation.

It is a further object of the present invention to provide a replacement control knob for a household appliance having control indicia that is user-configurable for multiple, discreet control settings.

It is a further object of the present invention to provide a replacement for an appliance control knob that features visually and tactilely distinctive appearance that is adaptable for use on a variety of appliance control configurations.

It is a still further object of the present invention to provide a replacement for an appliance control knob that features visually and tactilely distinctive appearance that may be selected to compliment the décor in the area surrounding the appliance.

It is a still further object of the present invention to provide a user-configurable decorative replacement control knob for a household appliance that is durable in construction, inexpensive of manufacture, carefree of maintenance, easily assembled, and simple and effective to use.

These and other objects are achieved according to the instant invention by providing a user-configurable replacement control knob for use on a household kitchen appliance, such as a stove or range. The decorative replacement control knob replaces conventional control knobs supplied with the appliance and allows individuals to tailor the aesthetics of the appliance to suit their preferences. The knob is user-configurable for knob control rotation direction by installing one of a plurality of uniquely configured indicator inserts into a receptacle on the forward side of the knob. The knob may also be adapted to interface with differing appliance control shaft configurations by inserting one of a plurality of torque inserts into a receptacle on the rearward side of the knob. Decorative faces on the knobs are visually fashioned in various color schemes and tactilely shaped to resemble various items related to sports, hobbies, animals, holidays, characters, seasonal icons, and other decorative forms that may be used to enhance or accent an overall kitchen décor. The replacement control knob provides the same function as a standard appliance control knob and allows appliance control knobs to be used as room decorating accessories.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right" are used as a matter of mere convenience, and are determined by standing and facing the knob as it would typically be installed on an appliance. The terms "front," "rear," "forward," and "rearward" are relative to a conventional household appliance wherein the "front" or "forward" portion is that which is typically viewed when facing to operate the appliance. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
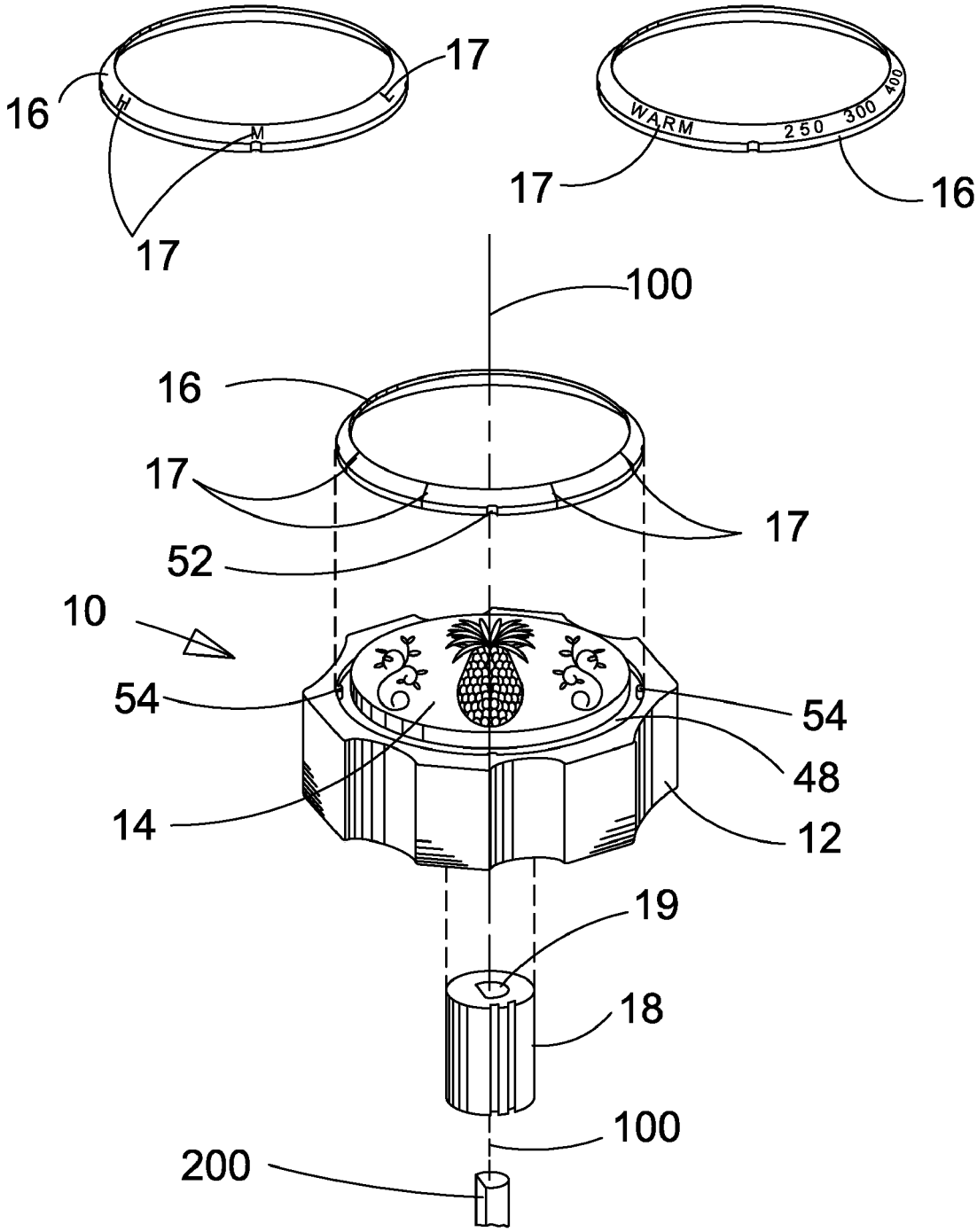
FIG. 1 is an exploded perspective view of one embodiment of a replacement control knob of the present invention.

First referring to FIG. 1, shown is one embodiment of a replacement household appliance control knob 10 the present invention comprising a base 12, a decoration 14, and a user-selectable indicator insert 16. The control knob 10 is of the type that is useful for manual control of a household appliance. The control knob 10 is configured for rotation about rotational axis 100, which is generally aligned with the control input shaft 200 on the appliance. An exemplar appliance might be a kitchen stove having one or more rotary control mechanisms for regulating the heat output of the various heating elements of the stove. Rotary control knobs are well known and generally include a rear-facing aperture for engaging an input shaft in a torque-transmitting manner. U.S. Pat. No. 2,283,905, issued to Beal on May 26, 1942, discloses one such torque-transmitting knob-control shaft interface and is incorporated in its entirety herein by reference. The design of such a rotary control knob enables the knob to be easily removed from the appliance, such as for cleaning, and then reinstalled. This design also allows the control knob to be easily replaced as long as the replacement knob features a compatible knob-shaft interface.

A household range generally features a single control knob for each of the heating surface control positions plus control knobs for an oven and an oven temperature selector. Thus, a typical household range might include six or more individual control knobs; however, indicia for communicating control information may vary between the knobs. Some of the knobs may be configured for increasing temperature in a clockwise direction, while other are rotated counter-clockwise to increase temperature. Oven controls typically include one mode control (e.g., off, bake, broil) and a second control for the oven temperature setting. Replacement knobs must, therefore, be configured for a variety of applications which requires either individual packaging of a variety of individual knobs or offering numerous pre-grouped configurations to address the variety of possible knob combinations.

One object of the present invention is to provide a replacement control knob for an appliance that features a pre-configured decoration 14 on the knob that allows the appliance appearance to be user-alterable by replacing the control knobs on the appliance. The decorative appearance on the visible portion of the replacement control knobs allows the user to establish a desired aesthetic decorative theme simply by replacing the control knobs using one having a specific decoration. Example themes might be sports, hobbies, holidays, seasonal, animals, and other special interests, all of which add visual interest to the appliance. Designs based on trademarks or other licensable intellectual property can also be formed allowing a wide range of special interests, such as collegiate and professional sports team logos, automobile racing, including NASCAR, Disney characters, and others to be depicted.

In order to offer a wide variety of decorations on the control knobs, the present invention strives to allow a single knob base assembly to be selectively configured by a user to suit the applications common on a conventional appliance. A user-selectable indicator insert 16 provided with replacement knob 10 allows a base 12 with a decoration 14 to be easily configured for multiple applications. Though shown as a ring inserted into the forward side, indicator insert 16 is only required to extend for the portion of the circumference necessary for indication, such as controls requiring less than 360 degrees of rotation for full control.

Figure 2:
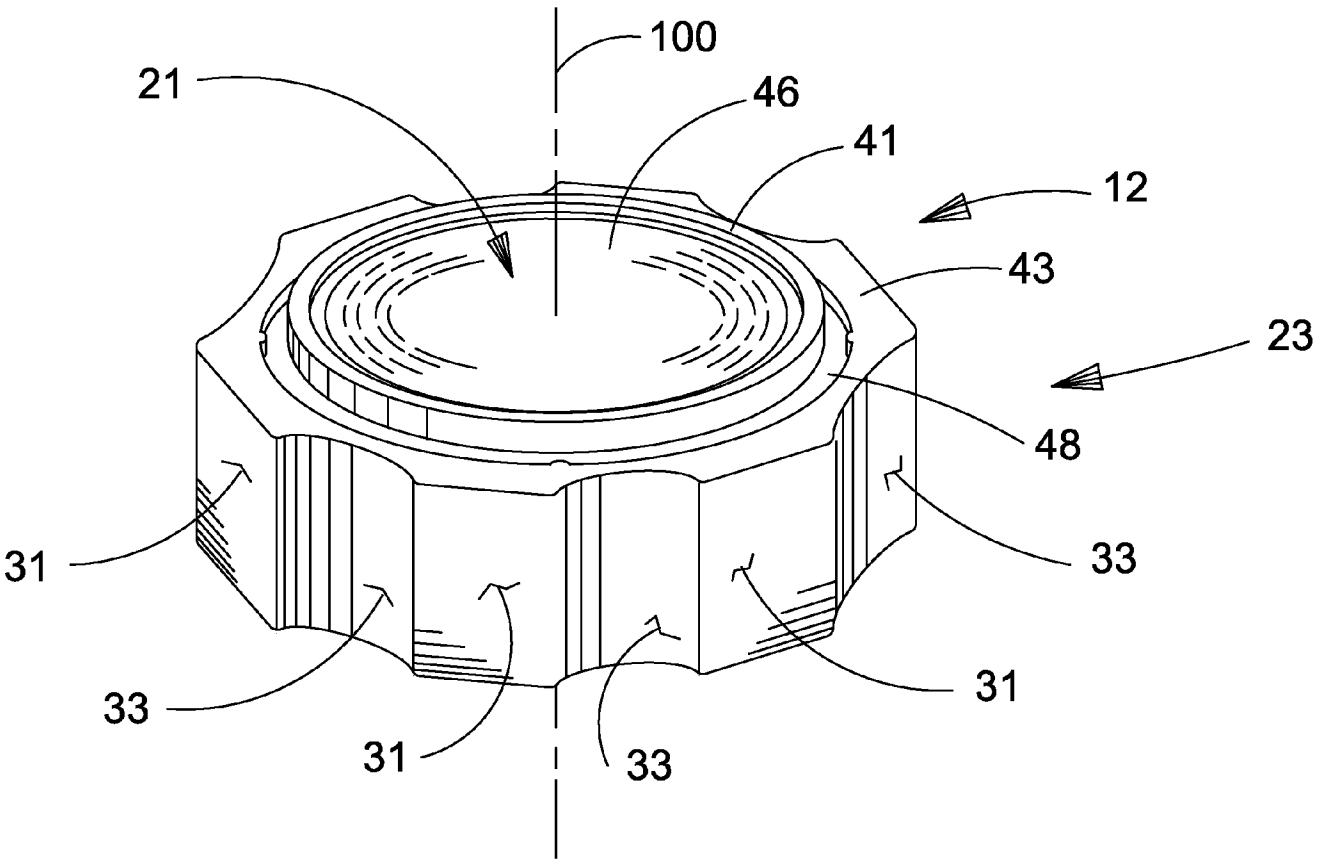
FIG. 2 is a perspective view of the front portion of one embodiment of a base structure of the present invention.
Figure 3:
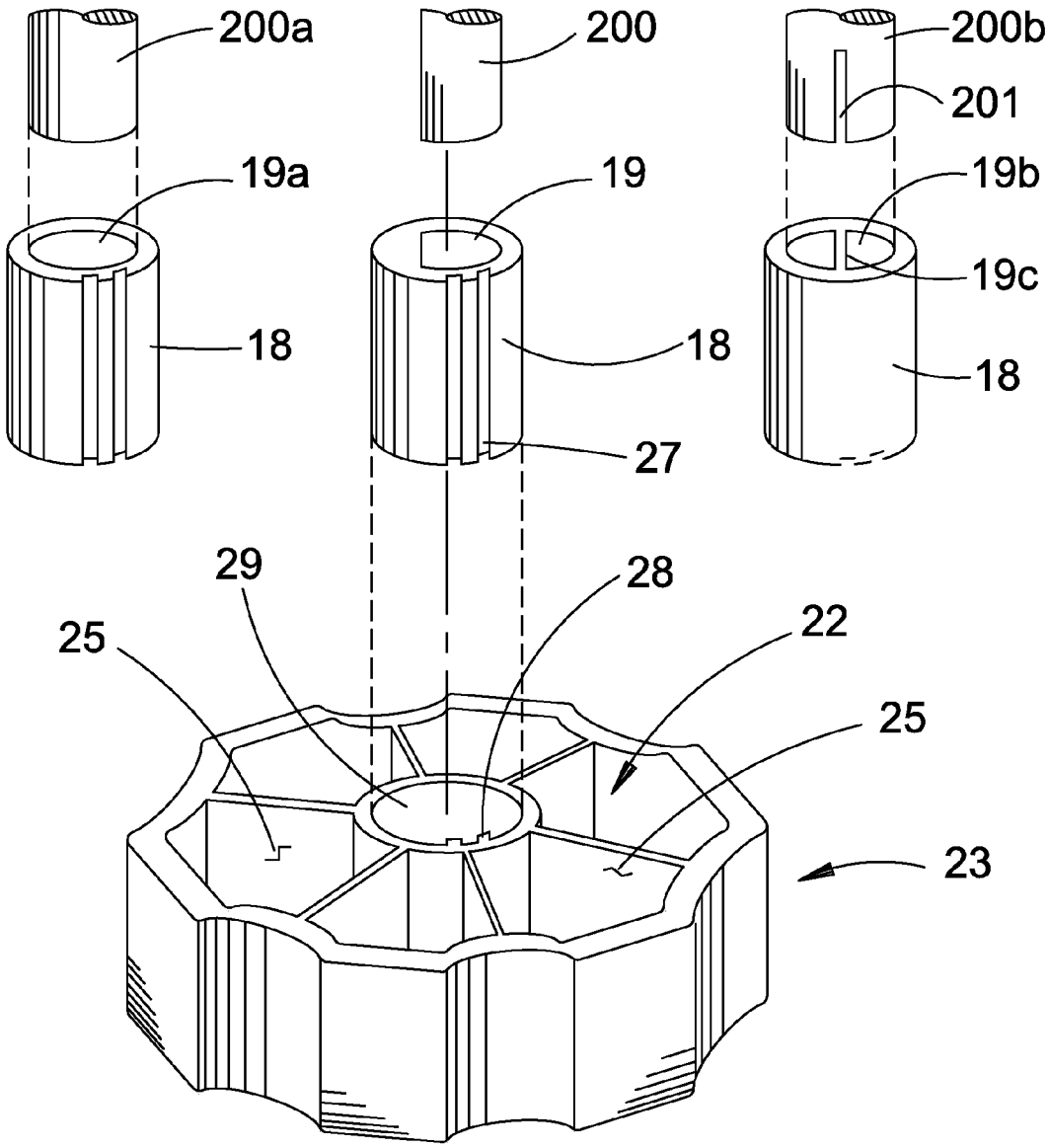
FIG. 3 is an exploded perspective view of the rear portion of the replacement control knob of the present invention.

Now referring to FIGS. 1 through 3, torque insert 18 is also provided to enable the combination base 12 and decoration 14 to be adapted for use on a variety of control shaft 200 configurations. Torque insert 18 features aperture 19 aligned on rotational axis 100 for engaging a control shaft 200 on an appliance. The size and configuration of aperture 19 is selected to match that of the appliance control shaft so that the replacement control knob 10 may be placed on the control shaft and enable the shaft to be rotated by rotating the control knob 10. In one embodiment shown in FIG. 1, torque insert 18 includes a D-shaped aperture 19 for engaging a D-shaped appliance control shaft 200 in a manner which prevents relative rotational movement between the knob and the shaft. In other embodiments, the inner diameter of aperture 19*a* may be formed approximately equal to the outer diameter of round appliance control shaft 200*a* to produce a sufficiently tight friction fit that prevents relative rotational movement or the aperture 19*b* may be provided with a bisecting "tongue" structure 19*c* configured to engage a groove 201 in the end of the control shaft 200*b*.

Base 12 is presented as a generally disk-like structure having a forward side 21 and a generally opposing rearward side 22 separated by an end 23. The disk-like base 12 may be generally circular or rounded, but need not be so. End 23 has a thickness dimension in the direction parallel to axis of rotation 100 to provide a convenient surface for grasping the knob. End 23 may be generally perpendicularly arranged relative to forward surface 21 to define the thickness of the base 12, but may also be angled slightly (+/−10 degrees) to provide a tapered end. Rearward side 22 may be planar as would be in the event that base 12 is generally solid, but is preferably hollowed out featuring a plurality of stiffening webs 25 to support the end 23 as is typical of a molded structure. In one embodiment, end 23 comprises a plurality of generally planar surface portions 31 separated by a plurality of sculpted surface portions 33 extending around the perimeter of the base 12 in an alternating, symmetrical pattern. The sculpted surface portions 33 are generally arcuately configured with a constant radius of curvature extending inwardly toward the center of the knob. The preferred arrangement features six planar portions 31 separated by six sculpted surface portions 33 similar in configuration to a 12-sided polygon wherein alternating planar surfaces are replaced by the arcuately-shaped sculpted portions when viewed in plan. A receptacle 29 disposed on rearward side 22 is provided to receive torque insert 18. One or more locking structures 28 may be provided to interlock with one or more grooves 27 on the exterior surface of torque insert 18 to prevent relative rotation between the knob and the insert when the insert is installed. By providing a plurality of grooves 27, the knob may be radially adjusted with respect to the appliance control shaft to align the knob and decoration to a desired rotary orientation.

In the preferred embodiment, base 12 is formed from a molded synthetic resin material that enables it to be formed as a single piece. A three-dimensional decoration 14 formed from cast synthetic resin is preferably affixed to the base in a manner that does not allow an end user to separate the two pieces once they have been joined. Cast synthetic resin is preferred for decoration 14 since it may be formed into extremely detailed three-dimensional shapes enabling depiction of other articles with great clarity.

Figure 5:
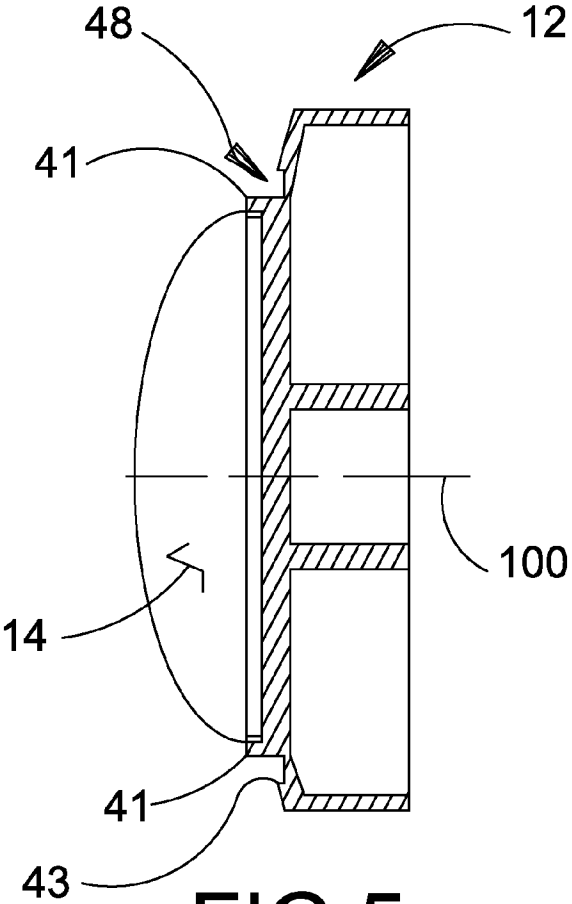
FIG. 5 is a section view of the control knob of FIG. 4 taken along cut line 5-5.
Figure 4:
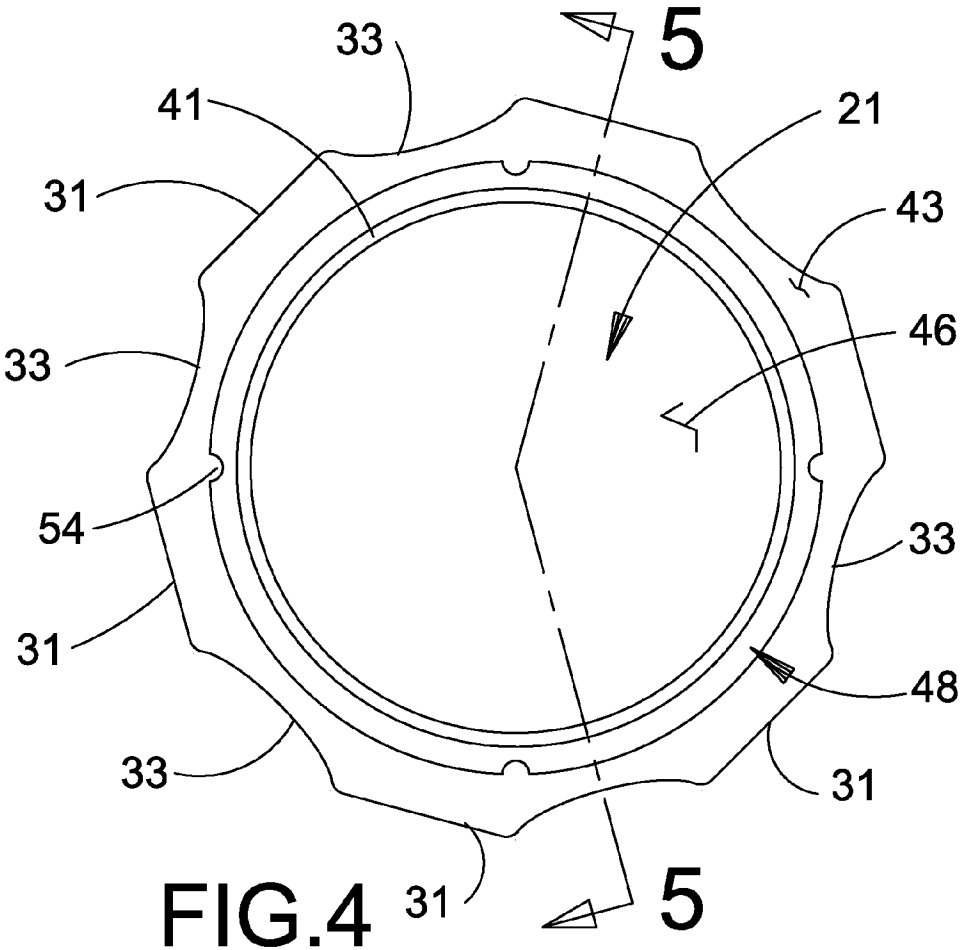
FIG. 4 is a plan view of the front portion of the control knob.

Now referring to FIG. 2 in conjunction with FIGS. 4 and 5, forward surface 21 is shown to further comprise a circular first receptacle 48 extending into forward surface 21. First receptacle 48 is bounded on the outward side by an outer peripheral structure 43 which is part of the forward surface 21, and on the interior side by a retaining structure 41. Retaining structure 41, being outwardly bounded by first receptacle 48, is inwardly bounded by a decoration receptacle 46. Decoration receptacle 46 features a generally planar surface bounded by the inward edge of circular retaining structure 41 and is thus configured to receive decoration 14 in a manner which centrally positions the decoration on the forward surface of base 12. Alternatively, the decoration receptacle may be flush with the forwardmost surface of retaining structure 41 which enables the decoration 14 to cover more of the viewable portion of the knob. First receptacle 48, being in the shape of an annular groove in the forward surface 21 of the base 12, is configured to receive indicator insert 16. In the preferred embodiment, the depth of first receptacle 48 is approximately equal to the thickness of indicator insert 16 so that the indicator insert 16 will produce a flush surface relative to the forward facing surfaces of the retaining structure 41 and outer peripheral structure 43.

Indicator insert 16 includes indicia 17 to correlate the rotary position of the knob 10 with the appliance control. Various indicator inserts may be economically provided to allow a single knob 10 to be used in a variety of appliance control configurations. To this end, indicator insert 16 is selectively removable and positionable by the user so that the knob 10 may be optimally configured for use on a variety of appliance controls. A plurality of tabs 54 are symmetrically spaced around the periphery of first receptacle 48 which align with a matching plurality of detents 52 on the outer periphery of indicator insert 16 in a manner to align indicator insert 16 relative to the base 12 and provide a discreet number of possible alignments of the indicator insert. The interlocking tabs 54 engaging with the detents 52 also prevent the indicator insert 16 from rotating in first receptacle 48 once inserted so that the relationship of the indicia 17 to the appliance will not shift once the ring has been installed.

In the preferred embodiment, knob base 12 will be provided with multiple indicator inserts 16, each configured for different common appliance control operational positions, and also multiple torque inserts 18 configured to fit different common control shaft configurations. The result is a highly flexible replacement decorative control knob that can be configured by a user to suit the operating characteristics of a particular appliance while simplifying manufacturing and inventory coordination demands by using a common element that can be easily adapted for a variety of common configurations.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A user-configurable decorative control knob for use on a rotary control shaft of a household appliance, the knob comprising:

a base structure having a forward side and a rearward side separated by an edge, said edge having a thickness dimension;

a rotational axis about which said edge is symmetrically arranged;

a first receptacle in said forward side, said first receptacle having a depth extending into said forward side, an outer wall and an inner wall separated by a gap, said gap having a width, said outer and inner walls aligned parallel to said rotational axis;

at least one tab extending from said inner wall or said outer wall into said gap a height that is less than said gap width;

a second receptacle disposed on said rearward side and symmetrically configured about said rotational axis;

a plurality of indicator inserts, each of said plurality of indicator inserts having an interior edge and an exterior edge separated by an annular width, said annular width being slightly less than said gap width such that one of said plurality of indicator inserts is selectively inserted into said first receptacle, each of said plurality of indicator inserts further having at least one notch for engagement with said at least one tab to prevent relative rotation of said plurality of indicator inserts relative to said gap, each of said plurality of indicator inserts having indicia for indicating rotary position of said control knob wherein said indicia on each of said plurality of indicator inserts is unique with respect to other indicia on the other of said plurality of indicator inserts; and a plurality of torque inserts, each of said plurality of torque inserts having an aperture configured for engagement on the control shaft wherein each said aperture is unique with respect to other said apertures in said plurality of torque inserts;

wherein said knob is selectively configured by inserting one of said plurality of indicator inserts into said first receptacle and by inserting one of said plurality of torque inserts into said second receptacle.

2. The knob as described in claim 1, further comprising a decoration connected to said forward side and centered about said rotational axis.

3. The knob as described in claim 2, wherein said first receptacle is symmetrically disposed about said rotational axis.

4. The knob as described in claim 3, wherein said edge is configured as a polygon having twelve edge portions when viewed along said rotational axis and further wherein half of said edge portions are generally planar surfaces aligned with said thickness dimension and further wherein every other edge portion is arcuately shaped and extends radially inwardly toward said rotational axis.

5. The knob as described in claim 4, wherein said plurality of indicator inserts includes at least one insert having indicia configured for clockwise control knob operation.

6. The knob as described in claim 5, wherein said plurality of indicator inserts includes at least one insert having indicia configured for counter-clockwise control knob operation.

7. The knob as described in claim 6, wherein said plurality of torque inserts includes at least one insert having a cylindrical aperture for receiving the rotary control shaft.

8. The knob as described in claim 7, wherein said plurality of torque inserts includes at least one insert having a cylindrical aperture with a bisecting structure for receiving the rotary control shaft.

9. The knob as described in claim 8, wherein said plurality of torque inserts includes at least one insert having a D-shaped aperture for receiving the rotary control shaft.

10. A user-configurable decorative control knob for use on a rotary control shaft of a household appliance, the knob comprising:

a base structure having a forward side and a rearward side separated by an edge, said edge having a thickness dimension;

a rotational axis about which said edge is symmetrically arranged; a first receptacle in said forward side, said first receptacle having a depth extending into said forward side, an outer wall and an inner wall separated by a gap, said gap having a width, said outer and inner walls aligned parallel to said rotational axis;

at least one tab extending from said inner wall or said outer wall into said gap a height that is less than said gap width;

a second receptacle disposed on said rearward side and symmetrically configured about said rotational axis;

an indicator insert having an interior edge and an exterior edge separated by an annular width, said annular width being approximately equal to said gap width such that said indicator insert is selectively inserted into said first receptacle, said indicator insert further having at least one notch for engagement with said at least one tab to prevent relative rotation of said indicator insert relative to said gap, said indicator insert having an indicia for indicating rotary position of said control knob selected from the group consisting of indicia indicating increasing control input for clockwise control operation, and indicia indicating increasing control input for counterclockwise control operation; and a torque insert having an aperture configured for engagement on the control shaft, said aperture selected from the group consisting of a cylindrical aperture, a D-shaped aperture, and a cylindrical aperture having a bisecting structure;

wherein said knob is selectively configured by inserting said indicator insert into said first receptacle and by inserting said torque insert into said second receptacle.

11. The knob as described in claim 10, further comprising a decoration connected to said forward side and centered about said rotational axis.

12. The knob as described in claim 11, wherein said first receptacle is symmetrically disposed about said rotational axis.

13. The knob as described in claim 12, wherein said edge is configured as a polygon having twelve edge portions when viewed along said rotational axis and further wherein half of said edge portions are generally planar surfaces aligned with said thickness dimension and further wherein every other edge portion is arcuately shaped and extends radially inwardly toward said rotational axis.

14. A user-configurable decorative control knob for use on a rotary control shaft of a household appliance, the knob comprising:

a base structure having a forward side and a rearward side separated by an edge, said edge having a thickness dimension;

a rotational axis about which said edge is symmetrically arranged;

a first receptacle in said forward side, said first receptacle having a depth extending into said forward side, an outer wall and an inner wall separated by a gap, said gap having a width, said outer and inner walls aligned parallel to said rotational axis;

at least one tab extending from said inner wall or said outer wall into said gap a height that is less than said gap width;

a second receptacle disposed on said rearward side and symmetrically configured about said rotational axis;

an indicator insert having an interior edge and an exterior edge separated by an annular width, said annular width being approximately equal to said gap width such that said indicator insert is selectively inserted into said first receptacle, said indicator insert further having at least one notch for engagement with said at least one tab to prevent relative rotation of said indicator insert relative to said gap, said indicator insert having an indicia for indicating rotary position of said control knob selected from the group consisting of indicia indicating increasing control input for clockwise control operation, and indicia indicating increasing control input for counterclockwise control operation; and a torque insert, said torque inserts having an aperture configured for engagement on the control shaft;

wherein said knob is selectively configured by inserting said indicator insert into said first receptacle and by inserting said torque insert into said second receptacle.

15. The knob as described in claim 14, further comprising a decoration connected to said forward side and centered about said rotational axis.

16. The knob as described in claim 15, wherein said first receptacle is symmetrically disposed about said rotational axis.

17. The knob as described in claim 16, wherein said edge is configured as a polygon having twelve edge portions when viewed along said rotational axis and further wherein half of said edge portions are generally planar surfaces aligned with said thickness dimension and further wherein every other edge portion is arcuately shaped and extends radially inwardly toward said rotational axis.

18. The knob as described in claim 17, wherein said aperture is a cylindrical aperture for receiving the rotary control shaft.

19. The knob as described in claim 17, wherein said aperture is a cylindrical aperture having a bisecting structure for receiving the rotary control shaft.

20. The knob as described in claim 17, wherein said aperture is a D-shaped aperture for receiving the rotary control shaft.

* * * * *